US007782215B1

(12) United States Patent
Knapp, Jr. et al.

(10) Patent No.: US 7,782,215 B1
(45) Date of Patent: Aug. 24, 2010

(54) CHILD SAFETY MOTION DETECTOR

(76) Inventors: Richard P. Knapp, Jr., 32 Oakland Rd., Pepperell, MA (US) 01463; Concetta M. Knapp, Jr., 32 Oakland Rd., Pepperell, MA (US) 01463

( * ) Notice: Subject to any disclaimer, the term of this patent is extended or adjusted under 35 U.S.C. 154(b) by 215 days.

(21) Appl. No.: 11/969,886

(22) Filed: Jan. 5, 2008

(51) Int. Cl.
*G08B 23/00* (2006.01)
*G08B 13/00* (2006.01)

(52) U.S. Cl. ..... 340/573.4; 340/517; 340/541

(58) Field of Classification Search ..... 340/541, 340/517–523, 552–567
See application file for complete search history.

(56) References Cited

U.S. PATENT DOCUMENTS 5,436,444 A * 7/1995 Rawson ..... 250/227.14
5,440,292 A * 8/1995 Bedrosian ..... 340/567
5,844,487 A * 12/1998 Britt ..... 340/573.4
5,905,436 A * 5/1999 Dwight et al. ..... 340/573.1
6,028,520 A * 2/2000 Maehre ..... 340/573.1
6,133,830 A * 10/2000 D'Angelo et al. ..... 340/571
7,081,817 B2 * 7/2006 Zhevelev et al. ..... 340/567
2007/0075860 A1 * 4/2007 Tracy ..... 340/556
2008/0204258 A1 * 8/2008 Dayton et al. ..... 340/600

* cited by examiner

*Primary Examiner*—Benjamin C Lee
*Assistant Examiner*—Michael Shannon

(57) ABSTRACT

A motion detecting device that is constructed of a device housing which has an upper motion detector and a lower motion detector mounted on a front face with a speaker for sounding an alarm mounted in the middle portion of the device housing, further includes an alarm mode switch, a power on/off switch, a battery pack and an attachment device on a back surface of the housing.

7 Claims, 5 Drawing Sheets

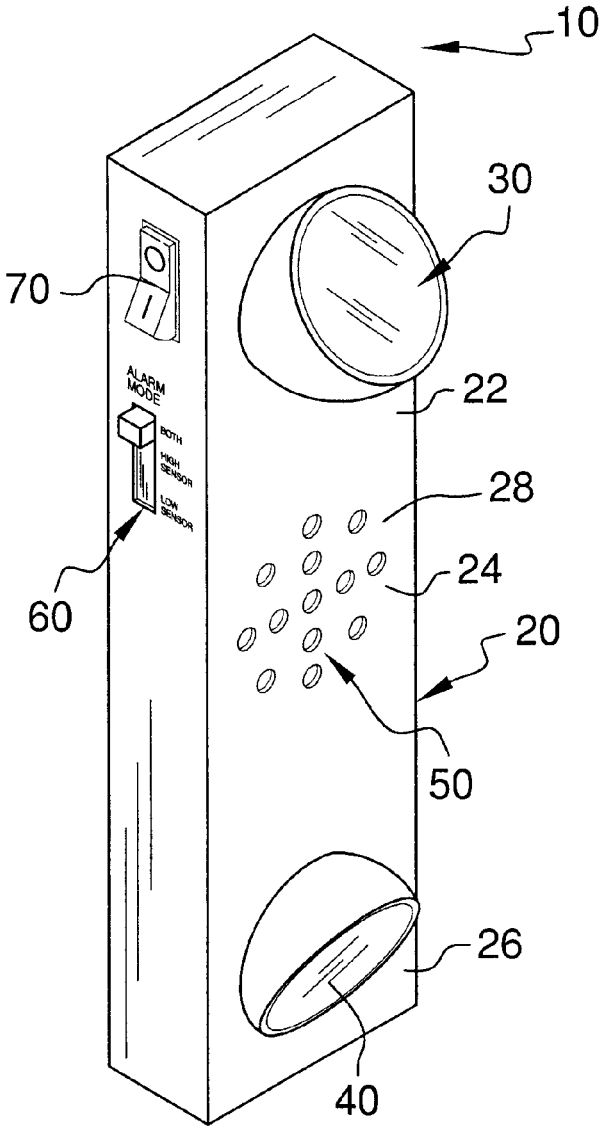
FIG. 1
FIG. 2
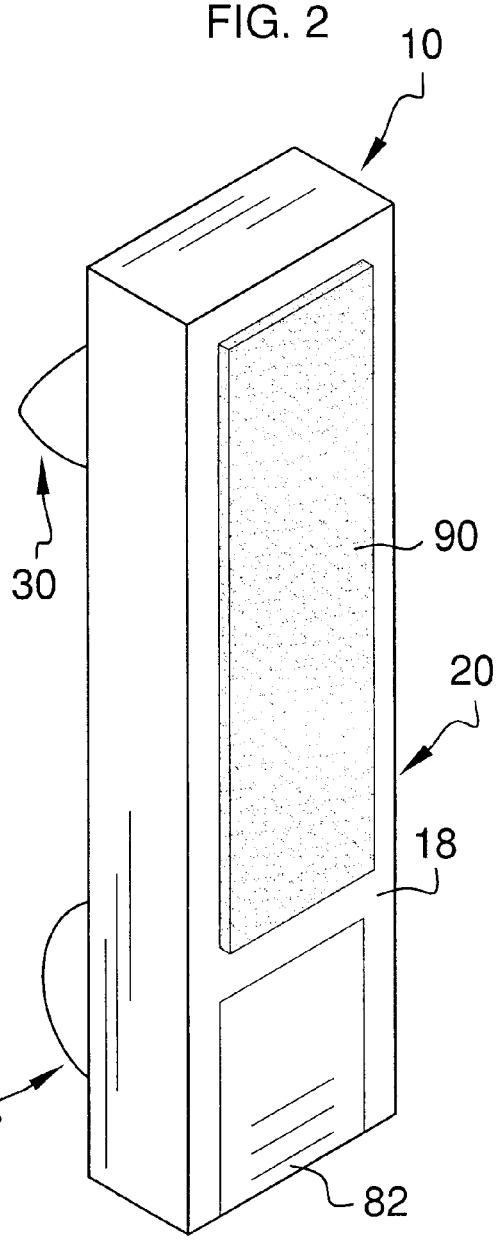

CHILD SAFETY MOTION DETECTOR

FIELD OF THE INVENTION

The present invention generally relates to a child safety device and more particularly, relates to a child safety motion detector for preventing a child from approaching a dangerous object in the kitchen.

BACKGROUND OF THE INVENTION

Child safety is of the most important concern of any family that has children. One of the frequently occurring accidents that can happen to a child is the burning hazard near a hot stove, an oven or a fireplace, i.e. any of the sources in a household that generates high heat. It is therefore desirable to provide a safety device for children to protect them from potential sources of hazard in a household.

It is therefore an object of the present invention to provide a child safety device that does not have the drawbacks or shortcomings of the conventional devices.

It is another object of the present invention to provide a child safety motion detecting device that prevents a child from approaching a potential hazard in a household.

SUMMARY OF THE INVENTION

In accordance with the present invention, a child safety motion detecting device is provided.

In a preferred embodiment, the present invention child safety motion detecting device can be constructed of a device housing of generally elongated rectangular shape for installing in an upright position; a first motion detector in an upper portion of a front surface of said housing; a second motion detector in a lower portion of said front surface of said housing; a speaker for sounding an alarm in a middle portion of said front surface of said housing; an alarm mode switch for selecting both sensor, high sensor or low sensor; a power on/off switch for turning on or off the two sensors; a battery pack in the housing for providing electrical power to the motion sensors; and an attachment means mounted on a back surface of the housing.

BRIEF DESCRIPTION OF THE DRAWINGS

The invention will now be described, by way of example, with reference to the accompanying drawings, in which:

FIG. 1 is a perspective view of the present invention child safety motion detector.

FIG. 2 is a perspective view of the present invention child safety motion detector showing the backside.

DETAILED DESCRIPTION OF THE PREFERRED EMBODIMENT

Figure 3:
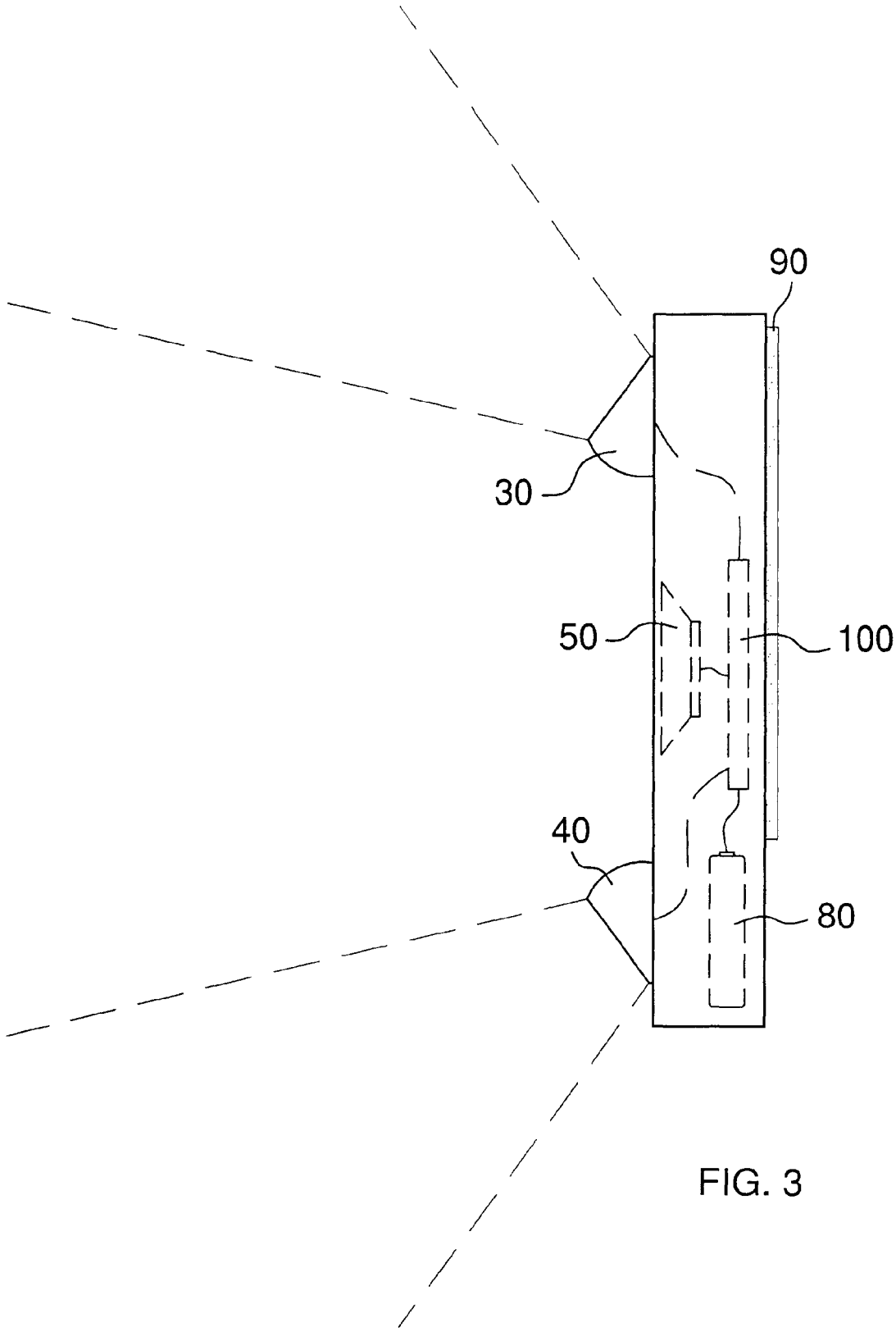
FIG. 3 is a side view of the present invention child safety motion detector.

The present invention discloses a child safety motion detector that can be used in the household for preventing a child from approaching a potential hazard object.

The present invention child safety motion detector is a pair of motion detectors that can be used to warn caregivers of a child or a pet approaching a range, wood stove, or fireplace. It consists of a pair of specially configured infrared motion detectors that can be mounted on a wall or possibly appliance housing by means of screws or adhesive-backed, hook-and-loop type fasteners. The present invention child safety motion detectors further equipped with an audible alarm for warning caregivers of a approaching child to a potential hazard.

The logic of the system is that motion detected by only the lower sensor, such as that caused by an approaching child or pet, would trigger the alarm. The system could also be set so that motion at either or both detectors can trigger the alarm. In an alternate embodiment, the present invention child safety motion detector features a cartoon character on the device housing.

The present invention child safety motion detector fulfills the need for a new type of home safety product. The appealing features of the present invention child safety motion detector are its ease of installation, adaptability, and the protection they can provide. The system can be installed in a relatively short period of time by even a novice do-it-yourselfer. It could be adapted for use on most gas and electric range installation, fireplaces, and wood stoves. In operation, the warning it would provide will help prevent young children, pets, or potentially adults with metal impairments from being burnt by such appliances and heating sources.

Referring initially to FIG. 1, wherein a child safety motion detecting device 10 is shown in a perspective view. The child safety motion detecting device 10 is constructed of a device housing 20 of generally elongated rectangular shape for installing in an upright position, such as that shown in FIGS. 1 and 2. A first motion detector 30 in an upper portion 22 of a front surface 24 of the housing 20. A second motion detector 40 in a lower portion 26 of the front surface 24 of the housing 20. A speaker 50, also shown in FIG. 3, for sounding an alarm in a middle portion 28 of the front surface 24 of the housing 20.

Additionally, an alarm mode switch 60 is provided for selecting between 3 positions of "both sensor", "high sensor", or "low sensor". A power on/off switch 70 is further utilized for turning on or off the two motion sensors 30, 40.

A battery pack 80, shown in FIG. 3, is further installed in the housing 20 for providing electrical power to the motion sensors 30, 40. An attachment means 90 which can be advantageously an adhesive layer, a mechanical device such as screws (not shown), or a hook-and-loop fasteners (not shown). Further shown in FIG. 2 is a battery compartment door 82 for accessing the battery 80. The attachment means 90 is mounted on a back surface 18 of the device housing 20. A microprocessor 100 may further be provided in the device housing 20 for providing control of the present invention device 10.

Figure 4:
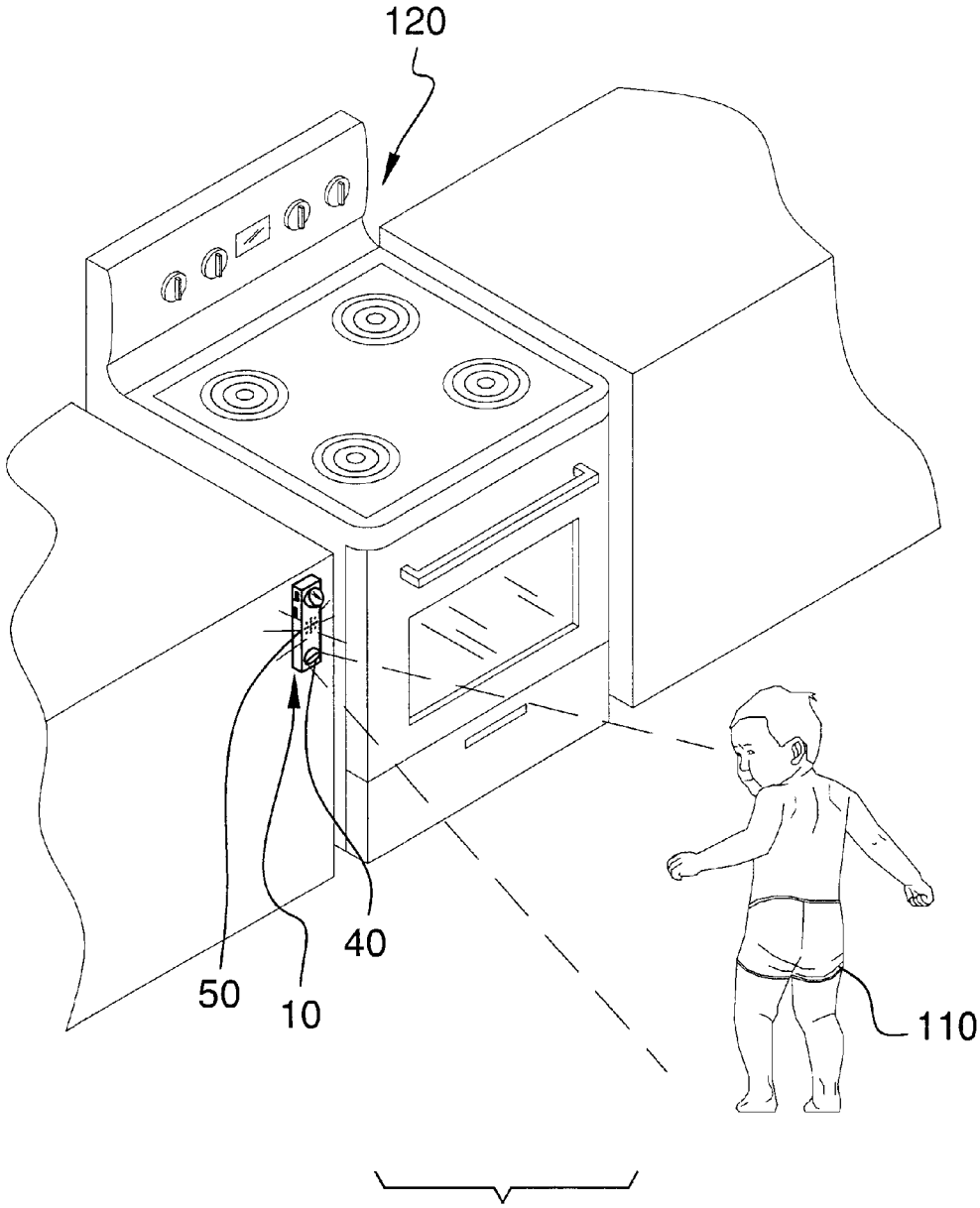
FIG. 4 is an illustration showing how the present invention motion detector is utilized.
Figure 5:
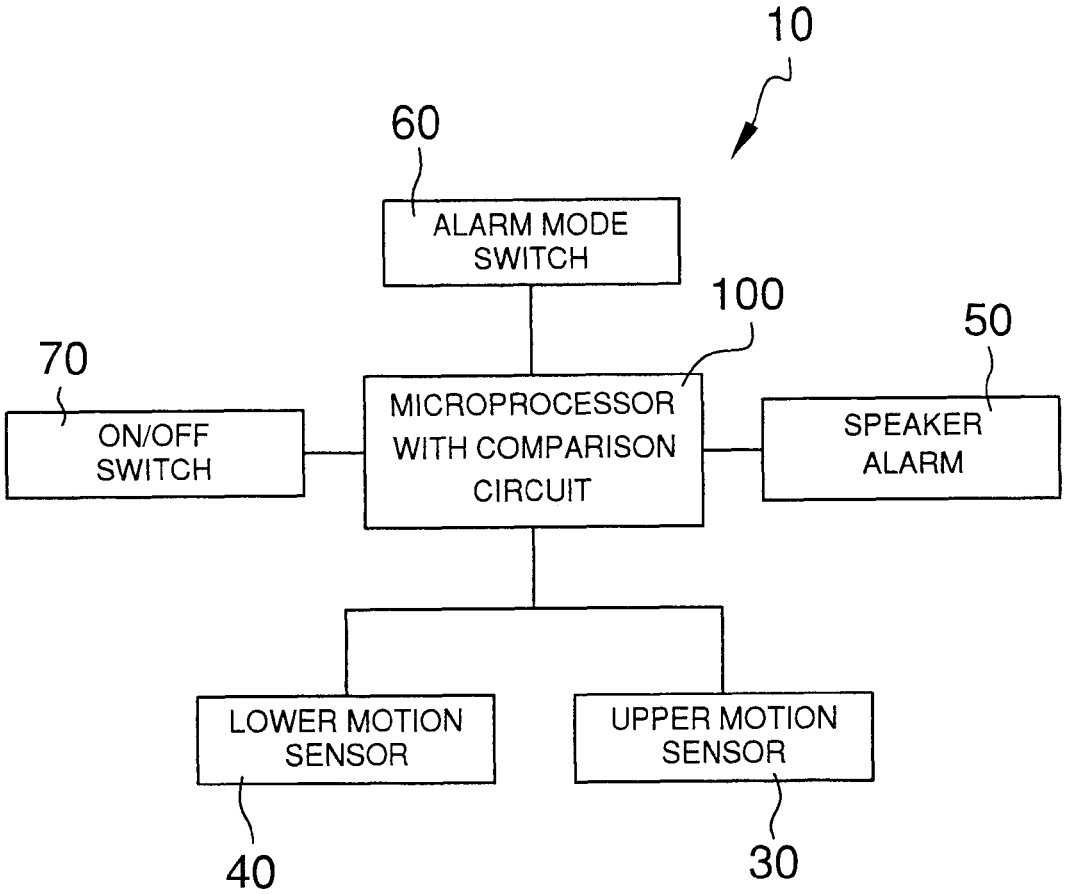
FIG. 5 is a functional block diagram for the present invention child safety motion detector.
Figure 6:
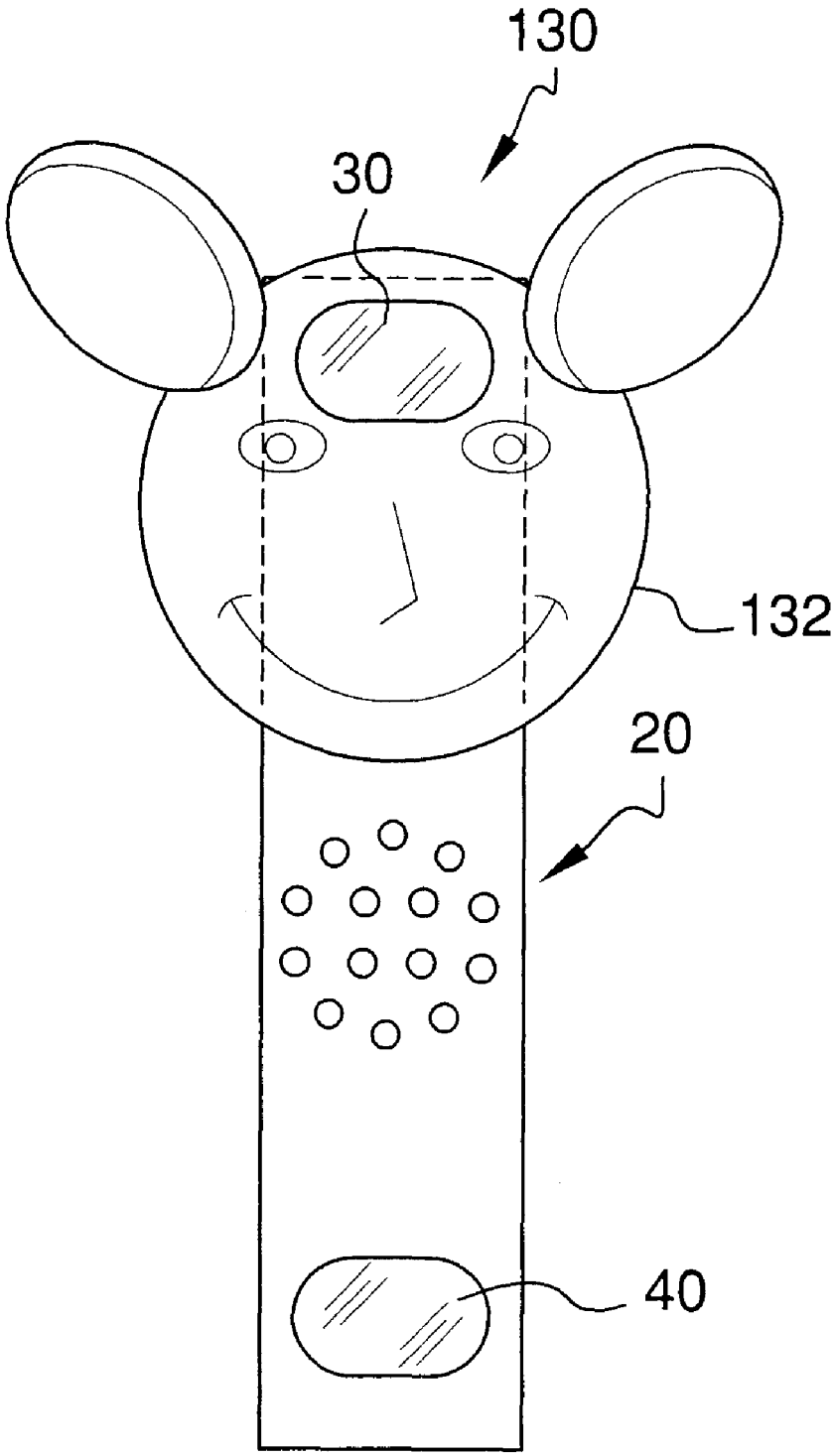
FIG. 6 shows an alternate embodiment of the present invention child safety motion detector.

To illustrate how the present invention child safety motion detector device 10 is utilized, such as that shown in FIG. 4, when a child 110 approaches an oven/range 120 which may be heated, the motion detecting device 10 would sense the presence of a child 110 by the lower motion sensor 40 and therefore sounding an alarm from the speaker 50 to alert a caregiver of the dangerous situation. A functional block diagram for the present invention child safety motion detecting device 10 is further shown in FIG. 5. While an alternate embodiment 130 for the present invention child safety motion detecting device that is equipped with a cartoon character 132 covering a top portion of the housing 20 is shown in FIG. 6.

The present invention child safety motion detecting device has therefore been amply described in the above descriptions and in the appended drawings of FIGS. 1-6.

While the preferred embodiments of the invention have been described above, it will be recognized and understood that various modifications can be made in the invention and the appended claims are intended to cover all such modifications which may fall within the spirit and scope of the invention.

What is claimed is:

1. A child safety motion detecting device comprising:

a device housing of generally elongated rectangular shape for installing in an upright position;

a first motion detector in an upper portion of a front surface of said housing;

a second motion detector in a lower portion of said front surface of said housing;

a speaker for sounding an alarm in a middle portion of said front surface of said housing;

an alarm mode switch for selecting both detectors, only the first motion detector or only the second motion detector;

a power on/off switch for turning on or off said two detectors;

a battery pack in said housing for providing electrical power to said motion detectors; and an attachment means mounted on a back surface of said housing.

2. The child safety motion detecting device according to claim 1, wherein said device housing is fabricated in a polymeric material.

3. The child safety motion detecting device according to claim 1, wherein said battery pack is a rechargeable battery pack.

4. The child safety motion detecting device according to claim 1, wherein said attachment means is an adhesive layer.

5. The child safety motion detecting device according to claim 1, wherein said attachment means is a hook-and-loop fastener.

6. The child safety motion detecting device according to claim 1, wherein said attachment means are screws.

7. The child safety motion detecting device according to claim 1 further comprising a microprocessor for controlling the device.

* * * * *